US010300616B2

(12) United States Patent
Schekalla

(10) Patent No.: US 10,300,616 B2
(45) Date of Patent: May 28, 2019

(54) KNIFE

(71) Applicant: MARTOR KG, Solingen (DE)

(72) Inventor: Peter Schekalla, Wuppertal (DE)

(73) Assignee: MARTOR KG, Solingen (DE)

( * ) Notice: Subject to any disclaimer, the term of this patent is extended or adjusted under 35 U.S.C. 154(b) by 0 days.

(21) Appl. No.: 15/151,225

(22) Filed: May 10, 2016

(65) Prior Publication Data

US 2017/0001318 A1 Jan. 5, 2017

(30) Foreign Application Priority Data

Jul. 2, 2015 (DE) ..... 10 2015 008 407

(51) Int. Cl.
*B26B 5/00* (2006.01)

(52) U.S. Cl.
CPC ..... *B26B 5/003* (2013.01); *B26B 5/001* (2013.01); *B26B 5/006* (2013.01)

(58) Field of Classification Search
CPC ..... B26B 5/003; B26B 5/001; B26B 5/006
See application file for complete search history.

(56) References Cited

U.S. PATENT DOCUMENTS 2,094,260 A * 9/1937 Brody ..... B26B 5/006 30/162
7,647,702 B2 1/2010 Polei
2010/0126024 A1* 5/2010 Price ..... B26B 5/001 30/162
2011/0283543 A1* 11/2011 Wu ..... B26B 5/003 30/162

FOREIGN PATENT DOCUMENTS

DE 3735294 A 4/1989
DE 202011050068 U 9/2011

OTHER PUBLICATIONS

ATB ("Lot of 10 Utility Knife Box Cutter Snap Off Lock Razor Blade Constructor Tool", Jan. 30, 2014, https://www.amazon.com/Utility-Cutter-Constructor-Assorted-Colors/dp/B00I52Q71Y/ref=pd_sbs_79_14?_encoding=UTF8&pd_rd_i=B00I52Q7IY&pd_rd_r=712e4432-941d-11e8-905a-8dd5e9b59285&pd_rd_w=TrXxv&pd_rd_wg=QwjXb&pf_rd_i=desktop-dp-sims&pf_rd_m=ATVPDKIKX0DER&pf.*

* cited by examiner

*Primary Examiner* — Kenneth E Peterson
*Assistant Examiner* — Liang Dong
(74) *Attorney, Agent, or Firm* — Andrew Wilford

(57) ABSTRACT

The invention relates to a knife with a housing (11) and with a blade holder (13) for holding a blade (17), the blade holder (13) being movable between a safety position in which the blade (17) is inaccessible within the housing (11) and a cutting position in which the blade (17) projects at least partially out of the housing (11), the cutting position being defined by the interaction of at least one stop surface (32*a*, 32*b*) associated with the housing (11) and at least one counterpart surface (23*a*, 23*b*) associated with the blade holder (13).

7 Claims, 4 Drawing Sheets

KNIFE

FIELD OF THE INVENTION

The invention relates to a knife having a housing and a blade holder movable between a safety position and a cutting position. In the safety position a blade retained in the blade holder is in the housing. In the cutting position the blade projects out of an opening in the housing. The blade holder is for example biased by a spring into the safety position.

FIELD OF THE INVENTION

The housing has a stop with a stop surface. In the cutting position the stop surface is in contact with a counterpart surface associated with the blade holder. The stop surface is directly or indirectly on the housing. The stop surface may be formed for example on an insert that is secured to the housing. The stop surface is in a movement path of the counterpart stop surface. The contact between the stop surface and the counterpart stop surface defines the cutting position of the blade holder. Thus in the cutting position the blade is moved out of the housing to the maximum extent. For example, further positions of the blade holder may be provided in which the blade projects out of the opening of the housing and in which cutting can take place.

Such a knife is known from DE 10 2005 057 213. Here the stop is adjustable. In this way different blade extension lengths can be set. The adjustment of the stop is done by an adjusting screw that passes through a slot in the housing and can be screwed into the stop. In this way the stop can be clamped to the housing in such a way that it is releasably secured in the set position on the housing.

At many workplaces the same cutting operation is carried out repeatedly, for which a specific blade extension length is suitable. In these cases, an adjustment possibility for the knife is not required. In these cases, an adjustment possibility could for example endanger the worker or could prejudice the cutting result because the worker sets an unsuitable blade extension length.

Nevertheless, it is undesirable for many different knives with varying blade extension lengths to be available at different workplaces.

OBJECT OF THE INVENTION

It is the object of the invention to create a knife that eliminates the above-mentioned disadvantages.

SUMMARY OF THE INVENTION

In the cutting position according to the invention the stop surface associated with the housing is in contact with a counterpart surface associated with the blade holder. Within the context of the invention "associated with the blade holder" means that the counterpart surface can be associated for example directly with the blade holder or for example to parts movably connected to the blade holder. Movably connected parts of the blade holder may be for example the actuator comprising the handle and a movement transmission device between the handle and the blade holder, as well as the blade itself.

For example, a module is releasably secured to the knife. A retaining surface that forms the stop surface or the counterpart surface is associated with the module. The module can be associated for example with the housing or the blade holder. Alternatively, the module may also be associated with the actuation. The provision of the retaining surface on the module defines a first blade extension length. The module 41 is interchangeable with at least one other module that can be selected from a set of at least two modules. The position of the retaining surface on the other module defines a second blade extension length.

With the knife according to the invention the same knife can be used for different applications in which different blade extension lengths are necessary. In this way the stock of parts can be reduced. Furthermore, according to the invention it is possible to set different blade extension lengths for the knife, and the knife housing can be closed so that the interior of the knife is not exposed to the danger of contamination.

The module can for example be secured releasably to the blade holder or to the housing. The module can be secured for example directly or indirectly to the housing or to the blade holder. It can be secured for example to an insert that can be secured to the housing.

The module can for example be secured in a mounting seat. This ensures that each module out of the set of modules has a defined position relative to the housing or to the blade holder. The mounting seat can for example be secured to the housing or to an insert associated with the housing or to the blade holder.

The module is provided with fastening means that can be brought releasably into engagement with counterpart fastening means of the blade holder or of the housing. In this way the module can for example be secured in positive or nonpositive engagement with the housing or to an insert associated with the housing or to the blade holder. The module can be secured for example be a latch assembly.

The retaining surfaces of the different modules of the set of modules are for example offset relative to one another in the direction of movement of the blade holder. The offset of the retaining surface relates for example to the fastening means. In this way the distance that the blade holder travels between the safety position and the cutting position changes with the different modules.

The retaining surface is for example formed by at least one projection. The projection extends for example transversely to the direction of movement of the blade holder. The projection may extend for example at a right angle to the direction of movement of the blade holder. Two or more retaining surfaces may be provided for example on the module. In this way the forces that each projection transmits are lower.

At least two stop surfaces are associated for example with the housing and at least two counterpart surfaces are associated with the blade holder.

The counterpart surface is for example arranged on at least one extension of the blade holder. For example, the blade holder forms an arm on which the counterpart stop is mounted. The extension can reach toward the rear for example in the direction of movement of the blade holder.

The stop surface of the housing is for example in the movement path of the counterpart surface of the blade holder. When the blade holder moves in the direction of the cutting position, it is stopped by contact of the counterpart surface with the stop surface, so that the cutting position is defined.

BRIEF DESCRIPTION OF THE DRAWING

Further advantages are disclosed with reference to an illustrated embodiment shown schematically in the drawings. In the drawings.

SPECIFIC DESCRIPTION OF THE INVENTION

Figure 1:
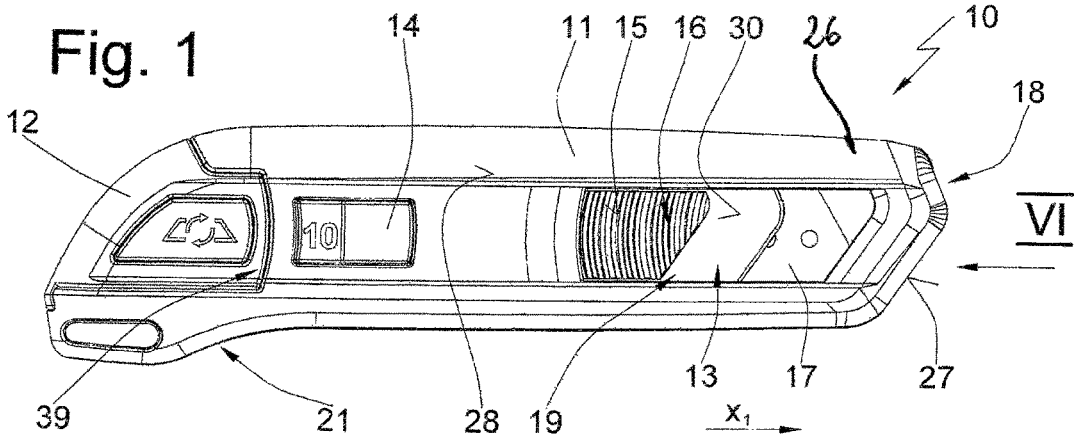
FIG. 1 is a side view of the knife in the safety position.

The knife as a whole is indicated in FIG. 1 at 10. The same reference numerals in the other figures designate corresponding parts.

According to FIG. 1 the knife 10 has a housing 11 and an insert 12. A blade holder 13 is associated with the insert 12.

The housing 11 serves as a handle that can be held by the user's hand. The housing 11 has a rear end 21 and a front end 26. The housing 21 has a rear opening 39 and the front end 26 has a front opening 18. Moreover, the housing 11 forms two opposite side faces 28 and 29. The side face 28 is provided with a slot-like opening 19 and the side face 29 is provided with a slot-like opening 20. The blade holder 13 can be actuated through the openings 19 and 20.

The blade holder 13 has opposite side faces 30 and 31 each provided with an actuating surface 15. In this embodiment each actuating surface 15 is provided with a structure 16 that prevents an actuating finger from slipping off. The blade holder 13 can be moved on the actuating surface 15 in a direction $x_1$ out of the safety position shown in FIG. 1 into the cutting position shown in FIG. 2 in which a blade 17 secured to the blade holder 13 extends out of the housing 11 through the opening 18. From the cutting position the blade holder 13 is moved back automatically in a direction $x_2$ by a spring (not shown) into the safety position as soon as the actuating surface 15 is released by the user.

The position in which the blade holder 13 has been moved back to the maximum extent and the blade 17 is retracted inside the housing 11 is designated hereafter as the safety position. Furthermore, there are further positions of the blade holder 13 in which the blade 17 is inside the housing 11. A spring (not shown) biases the blade holder 13 into the maximally retracted safety position. The position in which the blade holder 13 has been moved forward to the maximum extent and the blade 17 extends out of opening 18 in the housing 11 is designated as the cutting position. Furthermore, there are further positions of the blade holder 13 in which the blade 17 extends out of the housing 18.

Figure 2:
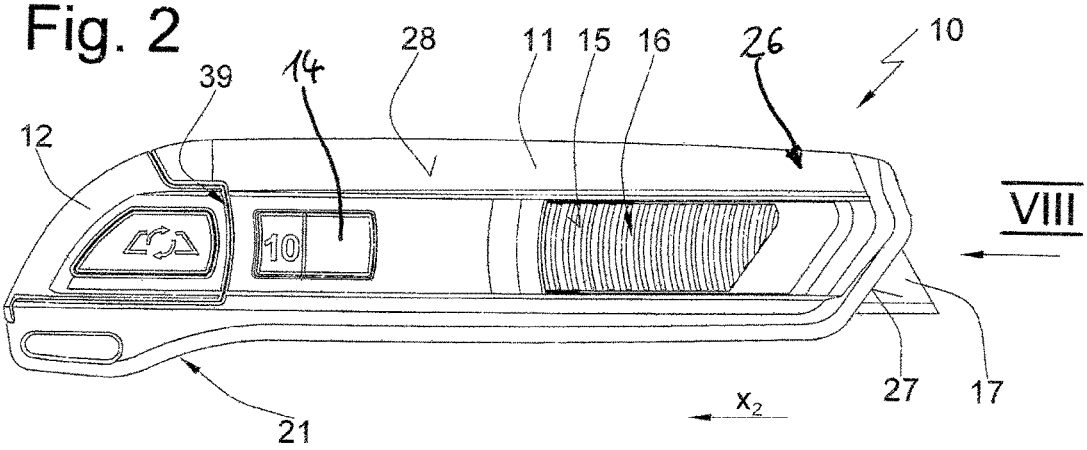
FIG. 2 is a side view of the knife in the cutting position.
Figure 2A:
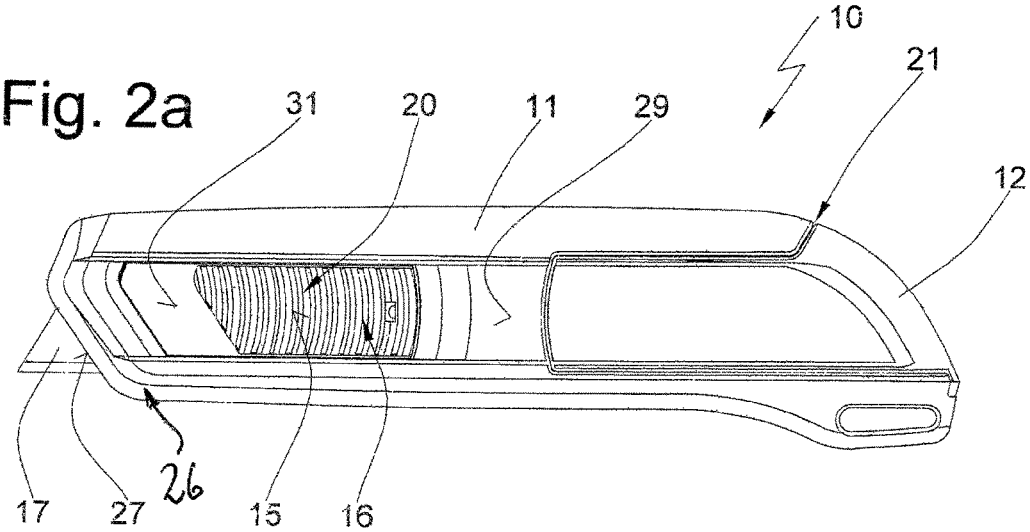
FIG. 2*a* is a side view according to the arrow II of FIG. 6.

Part of the insert 12 as well as the blade holder 13 are inserted into the housing 11 through the opening 39 at the rear end of the housing 21. In FIGS. 1, 2 and 2*a* the insert 12 is in a mounting seat of the housing 11 and is secured to the housing 11. Latch formations are provided on the insert 12 and on the housing 11, and the latch formation of the insert 12 and of the housing 11 can be brought releasably into engagement in order to fasten the insert 12 to the housing 11. When the insert 12 is secured in its mounting seat on the housing 11, it has a defined position relative to the housing 11.

Figure 3:
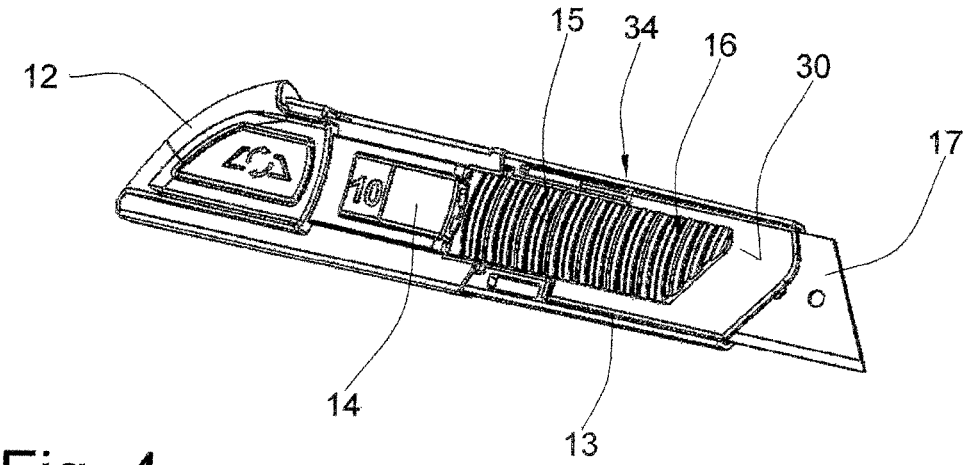
FIG. 3 is a perspective view of the assembly consisting of the insert, module, blade holder and blade in the safety position, FIG. 4, like FIG. 3, is a perspective view of the assembly in which the insert is not shown.
Figure 4:
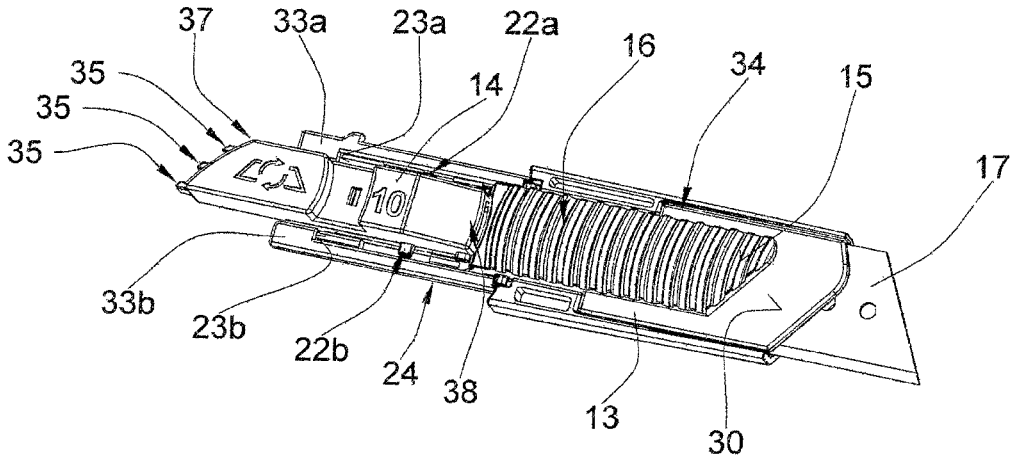
Figure 5:
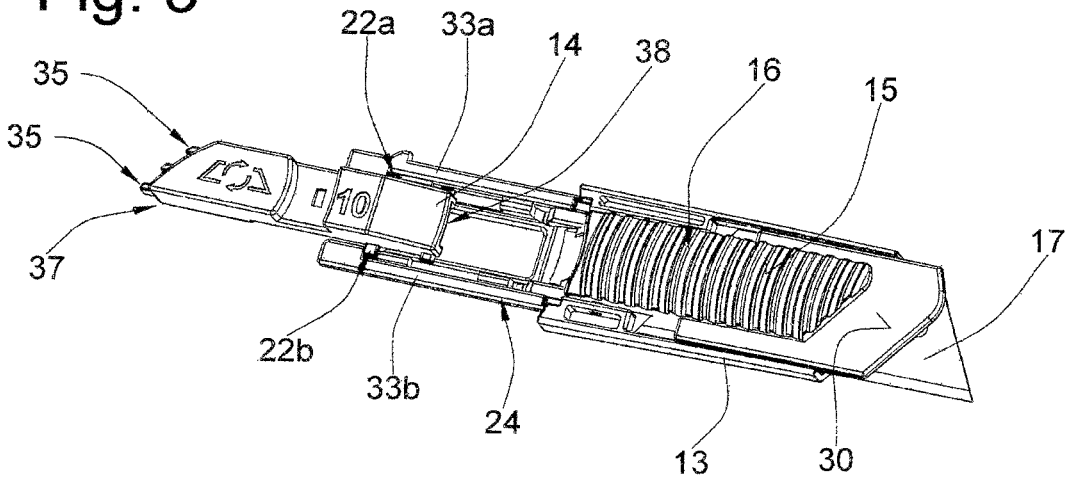
FIG. 5 shows the assembly as of FIG. 4 but in the cutting position.

The insert 12 can be released from the housing 11, for example, in order to change a blade or in order to replace a module 14 explained in greater detail below. If the insert 12 is released from the housing 11, the entire assembly shown in FIG. 3 comprising the insert 12, the blade holder 13 as well as the module 14 can be removed from the housing 11.

The module 14 is part of a set of at least two different modules. The blade extension length can be adjusted by the module 14. The length by which the blade 17 projects over a front housing face 27 is designated as the blade extension length.

Figure 7:
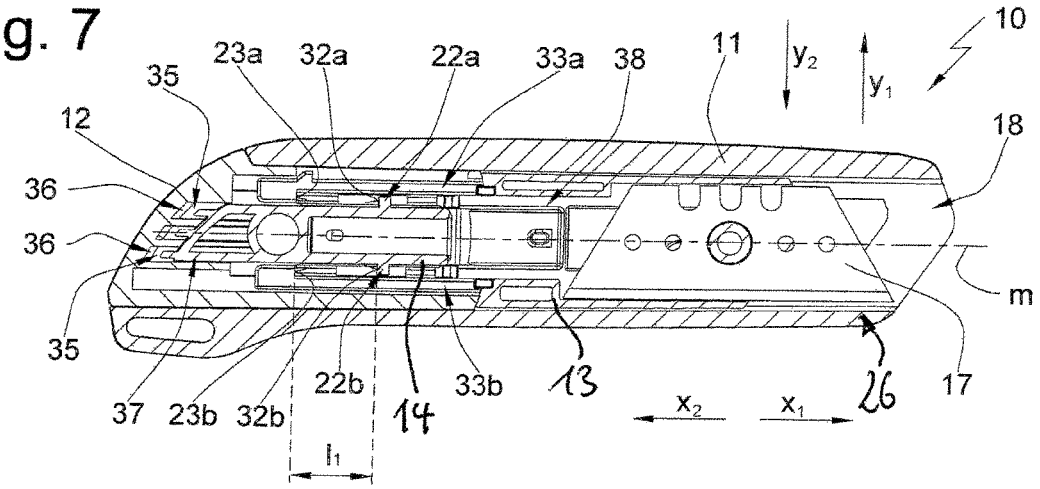
FIG. 7 is a section through the knife according to section line VII-VII of FIG. 6.
Figure 9:
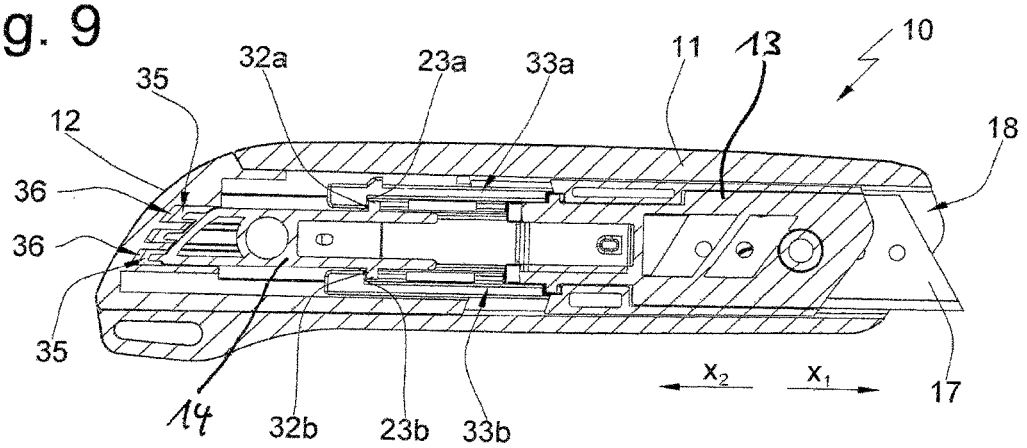
FIG. 9 is a section through the knife according to section line IX-IX of FIG. 8.
Figure 6:
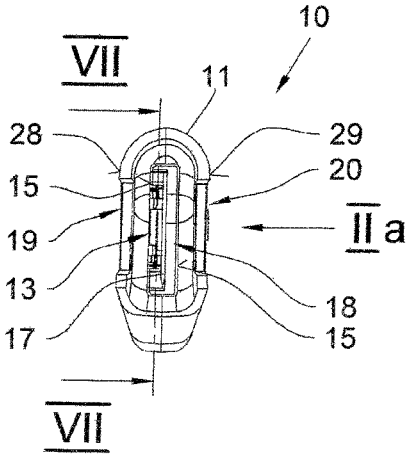
FIG. 6 is a front view of the knife according to arrow VI of FIG. 1.
Figure 8:
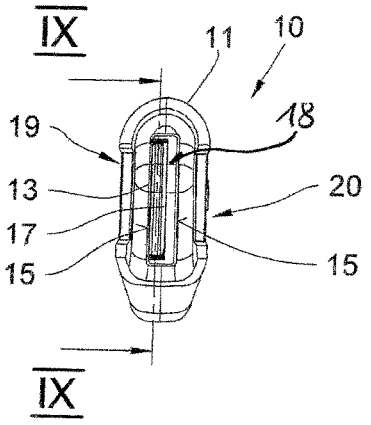
FIG. 8 is a front end view of the knife according to arrow VIII of FIG. 2.
Figure 10:
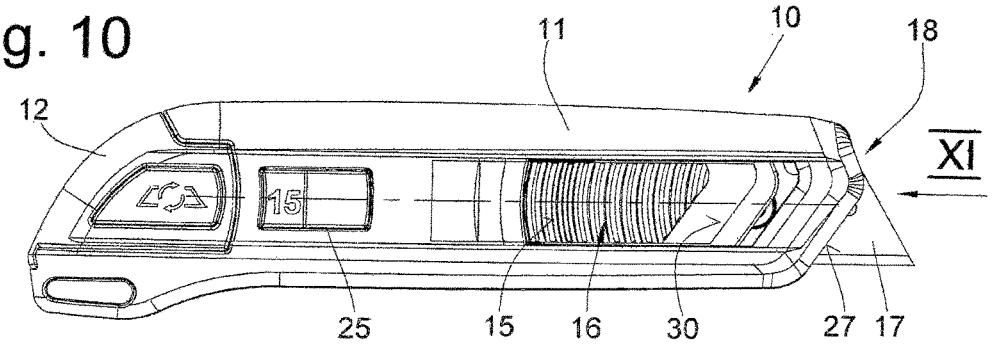
FIG. 10 is a side view like FIG. 2 of the knife in the cutting position, but with another module mounted on the knife.
Figure 11:
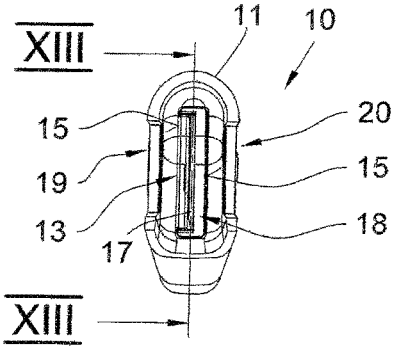
FIG. 11 is a front view of the knife according to arrow XI of FIG. 10.

The module 14 is retained by positive engagement in a mounting seat of the insert 12 and can be released from the insert 12. For fastening to the housing 11 by positive engagement, the module 14 has a plurality of projections 35 on a rear end 37 (see for example FIGS. 7 and 9) that can fit with cutouts 36 of the insert 12. At a front end 38 the module 14 is provided in a manner not shown with fastening means that can be brought releasably into engagement with counterpart fastening means of the insert 12. After mounting in the seat each module of the set of different modules has a defined position relative to the insert 12.

The module 14 has stops 22*a* and 22*b* that in this embodiment are formed by two projections extending direction $y_1$ and $y_2$ with respect to the external contour. The stop 22*a* forms a stop surface 32*a* and the stop 22*b* forms a stop surface 32*b*.

The blade holder 13 is provided with arms 33*a* and 33*b* that form an extension 24 reaching from a front region 34 of the blade holder 13 toward the rear in the direction $x_2$. The arm 33*a* is provided with a counterpart surface 23*a* and the arm 33*b* is provided with a counterpart surface 23*b*. The stop surfaces 32*a* and 32*b* and the counterpart surfaces 23 and 23*b* are for example symmetrical with respect to a longitudinal central axis m. In the safety position the counterpart surfaces 23*a* and 23*b* are in a defined position relative to the insert 12 and to the housing 11. In the safety position according to FIG. 7 the counterpart surface 23*a* and the stop surface 32*a* or the counterpart surface 23*b* and the stop surface 32*b* are spaced apart from one another by a distance 11. The distance 11 is the maximum distance that the blade holder 13 can travel in the direction $x_1$ until further movement in the direction $x_1$ is prevented by contact between the counterpart surfaces 23*a*/23*b* and the stop surfaces 32*a*/32*b*.

The stop surface 32*a* is in the path of movement of the counterpart surface 23*a* and the stop surface 32*b* is located in the path of movement of the counterpart surface 23*b*, when the blade holder 13 is moved in the direction $x_1$. The cutting position is defined in that the counterpart surfaces 23*a* and 23*b* are in contact on the stop surfaces 32*a* and 32*b* according to FIG. 9.

Figure 12:
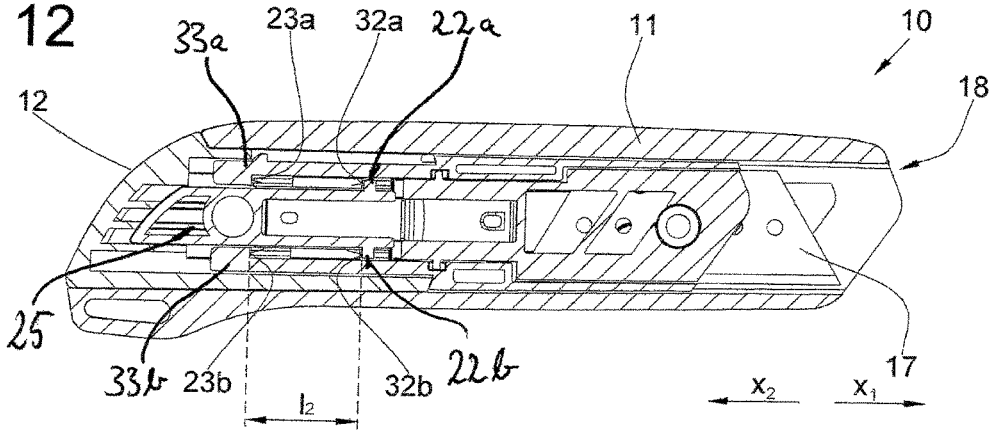
FIG. 12 is a section like FIG. 7 through the knife in the safety position, but with another module mounted on the insert.
Figure 13:
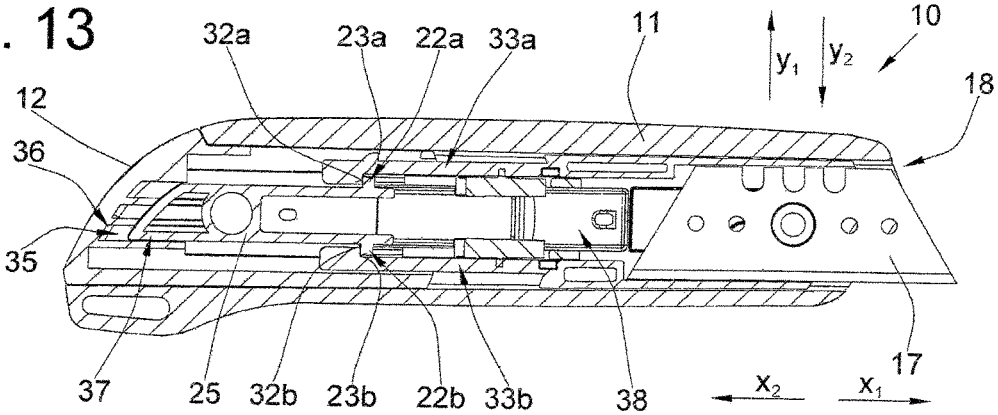
FIG. 13 is a section through the knife according to section line XIII-XIII of FIG. 11.

According to FIGS. 10 to 13 the knife 10 is provided with a second module 25. FIG. 12 shows the safety position and FIG. 13 shows the cutting position of the knife. The stop 22 is positioned in the second module 25 offset further in the forward direction $x_1$ than the first module 14. In the safety position according to FIG. 12 the counterpart surface 23*a* and the stop surface 32*a* or the counterpart surface 23*b* and the stop surface 32*b* are spaced apart from one another by a length 12 that is greater than 11. This means that the blade holder 13 in the second module 25 can be moved further in the direction $x_1$ compared with the first module 14, until the counterpart stop 23*a*/23*b* of the blade holder 13 comes into contact with the stop 22*a*/22*b*. The blade extension length is therefore greater.

The invention claimed is:

1. A knife kit comprising:

a longitudinally elongated housing;

a blade;

a blade holder holding the blade and movable longitudinally between a safety position in which the blade is inaccessible within the housing and a cutting position in which the blade projects longitudinally at least partially out of the housing and in which a stop surface fixed relative to the housing engages a counterpart surface fixed on the blade holder;

a spring connected between the blade holder and the housing and urging the blade holder into the safety position;

a set of at least two interchangeable modules each having a retaining surface and a fastening formation, a spacing of the retaining surface of each module relative to the respective fastening formation being different from a spacing of the retaining surface of any other module from the respective fastening formation;

a seat on the housing or on the blade holder fittable with any one of the modules but not more than one of the modules at the same time; and fastening means for fixing any single one of the modules but not more than one of the modules at the same time to the seat, the retaining surface of each module forming the stop surface when fixed in the seat of the housing or forming the counterpart surface when fixed in the seat of the blade holder, a longitudinal projection of the blade from the housing in the cutting position being defined by the longitudinal spacing of the retaining surface relative to the fastening formation of the module in the seat, the longitudinal spacings of the retaining surfaces from the respective retaining formations on the modules being different and defining different longitudinal projections of the blade from the housing depending on which module is in the seat.

2. The knife kit defined in claim 1, wherein the fastening means releasably secures the modules to the seat.

3. The knife kit defined in claim 1, wherein the fastening formations of the modules can be brought into engagement releasably with complementary fastening formations of the blade holder or of the housing.

4. The knife kit defined in claim 1, wherein the retaining surface of each module is formed by at least one projection of the respective module.

5. The knife kit defined in claim 4, wherein the projection of each module extends transversely with respect to the longitudinal direction of movement of the blade holder in the housing.

6. The knife kit defined in claim 1, wherein the stop surface is in a movement path of the counterpart surface.

7. The knife kit defined in claim 1, wherein the counterpart surface is on a rear extension of the blade holder.

* * * * *